United States Patent [19]

Latone

[11] Patent Number: 4,533,177

[45] Date of Patent: Aug. 6, 1985

[54] RECLINING CHAIR

[75] Inventor: Thomas L. Latone, Quakertown, Pa.

[73] Assignee: Knoll International, Inc., New York, N.Y.

[21] Appl. No.: 151,776

[22] Filed: May 21, 1980

Related U.S. Application Data

[63] Continuation-in-part of Ser. No. 046,010, Jun. 6, 1979, abandoned.

[51] Int. Cl.[3] ..... A47C 3/00

[52] U.S. Cl. ..... 297/301; 297/61; 297/285

[58] Field of Search ..... 297/313, 303, 304, 305, 297/306, 326, 285, 291, 300, 301, 302, 61

[56] References Cited

U.S. PATENT DOCUMENTS 1,829,434 10/1931 Bair ..... 297/301

2,073,872 3/1937 Kliesrath ..... 297/301 X

FOREIGN PATENT DOCUMENTS 1079933 5/1954 France ..... 297/301

815779 7/1959 United Kingdom ..... 297/301

*Primary Examiner*—James T. McCall

*Attorney, Agent, or Firm*—Robert Scobey

[57] ABSTRACT

A reclining chair having a seat portion connected pivotally at its forward end includes an arm compressible with progressive resistance to support the rear of the seat portion. The compressible arm is arranged to form with the seat portion an angle which continually decreases as the chair is reclined, and continually increases as the chair is returned to its upright position. In one embodiment, the compressible arm travels through a horizontal position so that it may be kept as close as possible to the horizontal at all times.

8 Claims, 8 Drawing Figures

FIG. 4
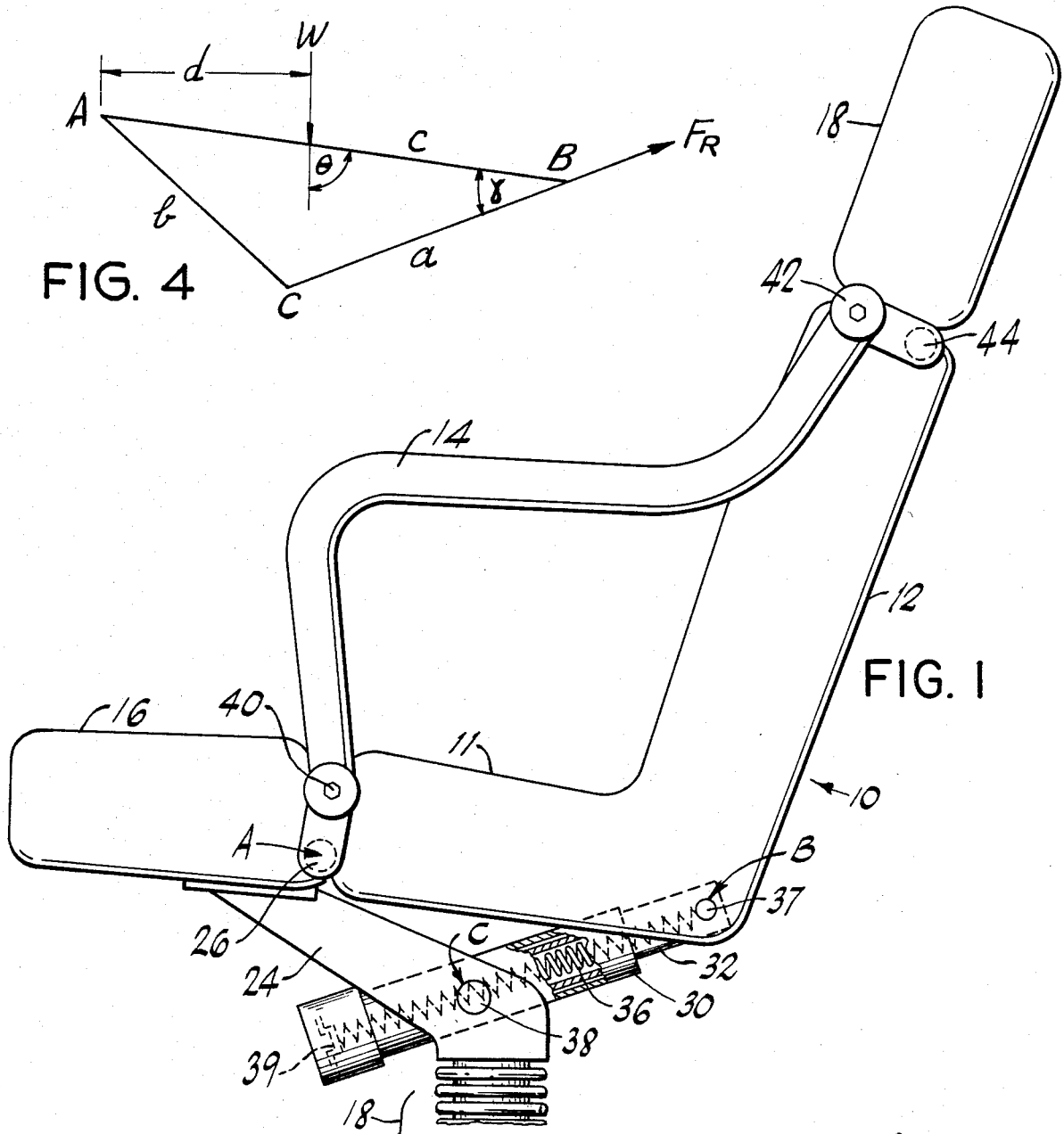
FIG. 1
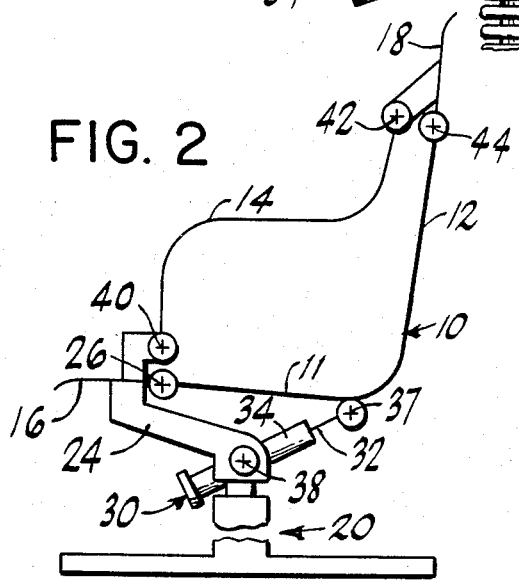
FIG. 2
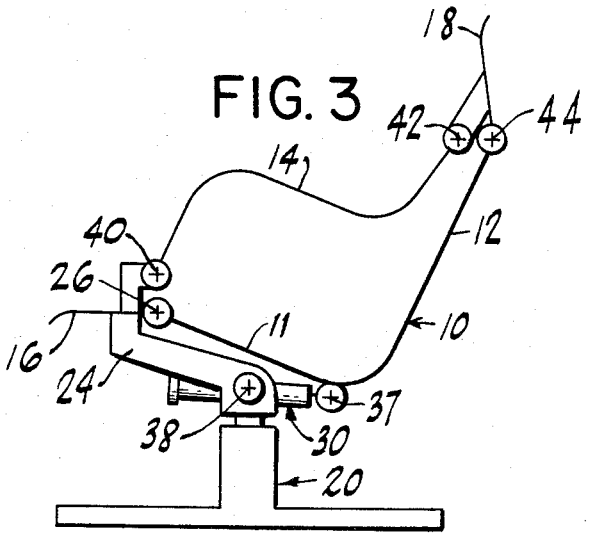
FIG. 3

FIG. 8
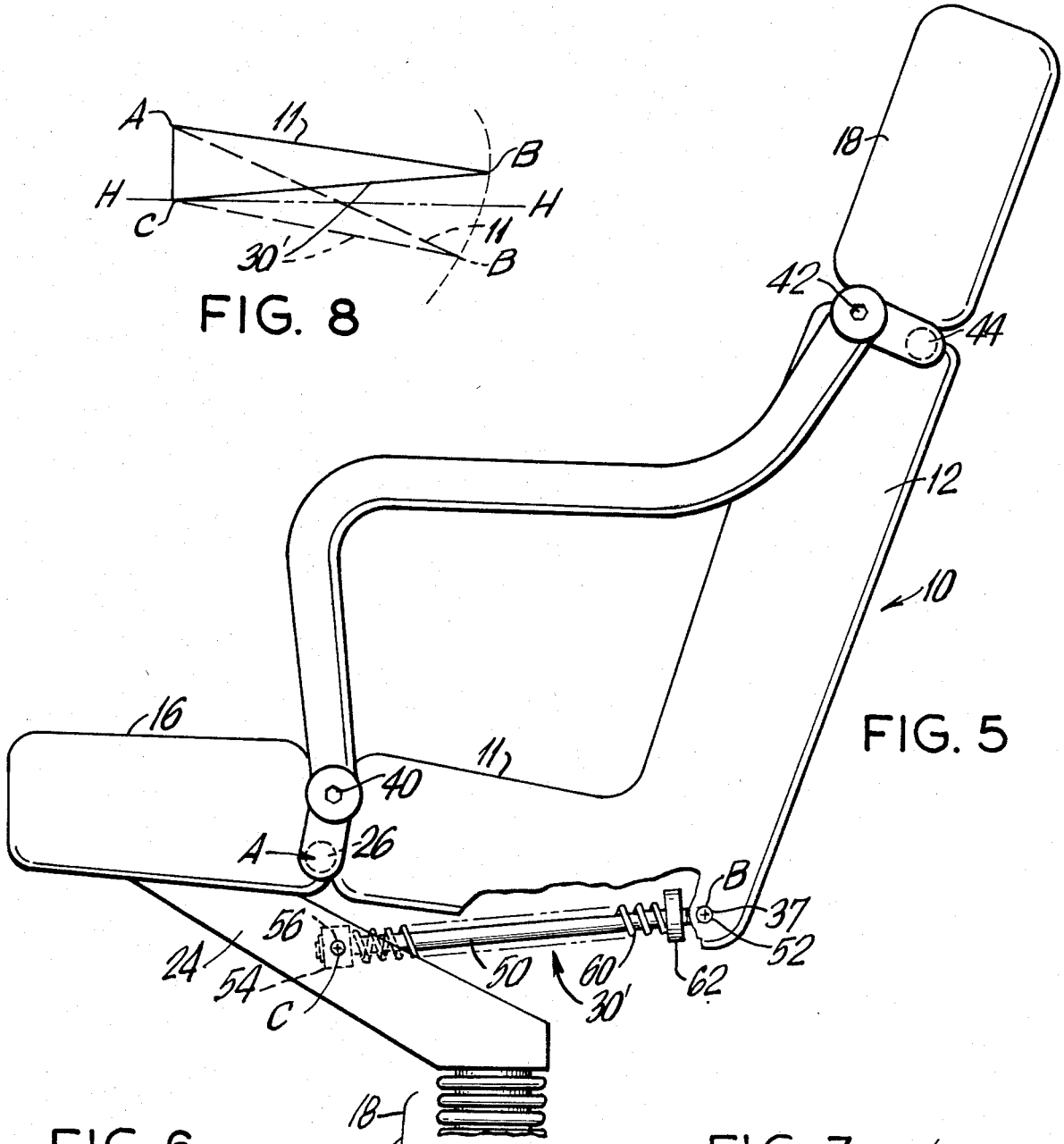
FIG. 5
FIG. 6
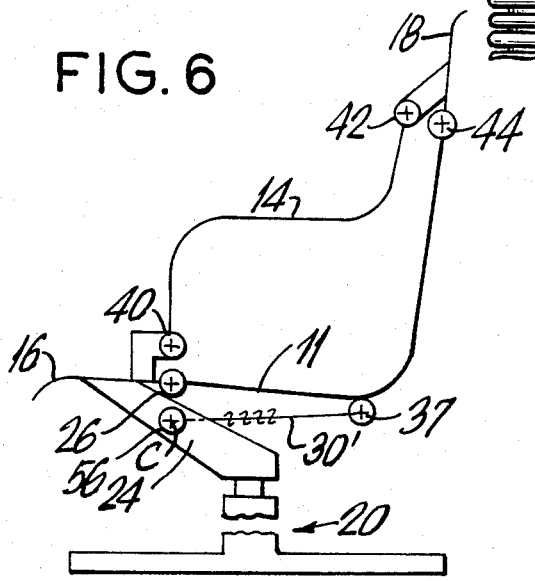
FIG. 7
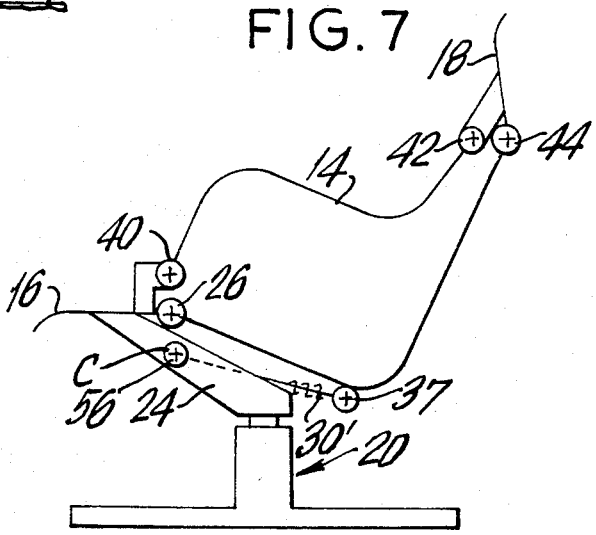

RECLINING CHAIR

This application is a continuation-in-part of my copending application Ser. No. 046,010 filed June 6, 1979, now abandoned.

The present invention relates to reclining chairs and, more particularly, to such chairs having seat portions supported pivotally about their forward ends.

Chairs which may be reclined by the user are known and typically include a seat portion mounted pivotally so that the user may move it into a reclining position by simply shifting his weight rearwardly, or return it to an upright position by shifting his weight forwardly. Typically, such chairs are spring loaded so that the transition between the reclining and upright positions can be made smoothly and with minimal effort.

In such chairs, the pivotal connection between the seat portion and the base of the chair is often located below the center of gravity of the user, and thus there is at most a small moment force exerted on the pivotal connection by the user's weight when the chair is in the upright position. Thus the spring, which normally acts upon the rear of the seat portion, need exert a force comparable only to the user's weight to maintain equilibrium. This spring force, however, can be overcome by the user shifting his weight rearwardly to increase the moment force caused by his weight. Similarly, the chair can be returned easily to its upright position by the user shifting his weight forwardly. Examples of such chairs are described in U.S. Pat. Nos. 2,420,745 and 3,989,297.

With such chairs, however, the front of the seat portion is raised as the chair moves into its reclined position and thus the legs of the user are forcibly raised out of comfortable engagement with any leg support. To prevent this, the pivotal connection between the seat portion and the chair base is often made at the forward end of the seat portion. Unfortunately, the user's weight thus creates a rather large moment force about the pivotal connection. This large moment force must be countered by a suitably large spring force acting on the rear of the seat portion. Consequently, the mere rearward for forward shift of the user's weight has less of an effect on the spring force. Thus it is often difficult to assure smooth movement between the upright and reclining positions of the chair with minimal force without relatively complex arrangements such as those illustrated in U.S. Pat. No. 4,143,910.

It is, therefore, an object of the present invention to provide a reclining chair pivoted about the forward end of its seat portion and yet having a simple mechanism for assuring smooth and balanced operation throughout its entire range of motion.

According to the present invention, this is accomplished by providing a chair having a seat portion connected pivotally at its forward end to the base of the chair. The seat portion is adapted to be reclined, and means including an arm compressible with progressive resistance supports the rear of the seat portion. The arm is connected pivotally to the rear of the seat portion and the base of the chair in a manner forming an angle with the seat portion of preferably no greater than 45°, but at least of a size and orientation that the angle continually decreases during reclining of the seat portion and, of course, continually increases during return of the seat portion to its upright position.

It has been found that in this way, the chair can be moved between its upright and reclining positions with relative ease as the forces resisting and assisting movement of the chair are never more than slightly out of balance during the full range of motion of the chair.

In one embodiment of the present invention, the arm is connected to that portion of the chair base which is located generally below the center of gravity of the user. In this case, the arm preferably includes an outer tubular member, an inner tubular member slidable telescopingly within the outer tubular member, and a spring held upon compression between the opposing ends of the two tubular members. Additionally, means are provided for adjusting the distance between these opposing ends to thus vary the spring force.

Another embodiment of the present invention has the compressible arm arranged at a more acute angle so that it passes through the horizontal during movement of the chair between its two extreme positions. The arm may thus be connected to that portion of the chair base located generally below the forward end of the seat portion. The arm then may include a rod connected pivotally at one end to the rear portion of the seat portion and its other end extending slidably through a block mounted pivotally to the base of the chair. A compression spring would be held between this block and a knob threadedly engaged with the rod whereby the compression of the spring may be adjusted by turning the knob.

These and other objects, features and advantages of the present invention will become apparent from the following detailed descriptions of two embodiments thereof taken in conjunction with the accompanying drawings, in which:

FIG. 1 is a side elevational view of a chair illustrating one emboidment of the present invention;

FIG. 2 is a diagrammatic view of the chair in FIG. 1 in its upright position;

FIG. 3 is a diagrammatic view of the chair in FIG. 1 in its reclined position;

FIG. 4 is a diagram illustrating the important geometric relationships of the present invention;

FIG. 5 is a side elevational view of another embodiment of the present invention;

FIG. 6 is a diagrammatic view of the chair of FIG. 5 in its upright position;

FIG. 7 is a diagrammatic view of the chair of FIG. 5 in its reclined position; and FIG. 8 is a diagram illustrating operation of the embodiment of FIG. 5.

Referring to the drawings, there is shown at FIG. 1 a first embodiment of the present invention which includes a chair 10 having a seat portion 11 connected for integral movement with a backrest 12. The seat portion 11 and backrest 12 may be formed by any of several conventional techniques and materials, and typically include a suitably contoured rigid member covered by upholstery. The chair may further include a pair of arm rests 14, a shoulder rest 18, and a leg rest 16 suitable for supporting the user's thighs. Preferably, shoulder rest 18 and leg rest 16 are made in a manner similar to that of the seat portion 11, and the arm rests 14 are preferably rigid members suitably padded.

A base portion 20 supports the chair, and this base portion may be of the type permitting the chair to swivel about a vertical axis, and also may allow the height of the chair to be altered. The base portion 20 includes a support 24 extending forwardly and upwardly. This support arm 24 supports the leg rest 16 at a fixed height and has the seat portion 11 connected pivotally thereto by hinge structure 26 extending along the axis A. The seat portion 11 and backrest 12 integral therewith may thus be tilted into a reclining position about the axis A without forcibly raising the user's legs from engagement with the leg rest 16.

Further, an arm 30 compressible with progressive resistance supports the rear of the seat portion 11. The compressible arm 30 may be any of several known types of devices that can be compressed longitudinally, but offer increasing resistance to such compression as the length is reduced. Typically, such devices are spring loaded, but pneumatic and such devices may also be used. For the embodiment illustrated in FIG. 1, a compressible arm formed by an inner tubular member 32 fitted within an outer tubular member 34 as so to slide telescopingly therein is preferred. A spring 36 is held under compression between the opposing ends of the two tubular members and conventional means 39 are provided to adjust the length and thus force of the spring 36.

The compressible arm 30 is connected pivotally to the base portion 20 by a hinge structure 38 and, in the embodiment of FIG. 1, the connection is preferably made at a location generally below the center of gravity of a person sitting upon the seat portion in its upright position. The compressible arm 30 extends to the rear of the seat portion 11 where it is connected pivotally by hinge structure 37. The compressible arm 30 is thus able to pivot about an axis B at its connection to the seat portion 11, and about axis C at its connection to the base portion 20. The compressible arm 30 is preferably connected at its mid region to the base portion 20. In this way, the maximum length of the arm 30 is not dictated by the spacing between the axes B and C, and the adjusting means 39 may extend to a more accessible location.

The seat portion 11 and integral backrest 12 may thus be tilted rearwardly against the resistance of the compressible arm 30. Preferably, the arm rests 14 are connected pivotally by hinge structure 40 to the support arm 24 and also to the shoulder rest 18 by hinge structure 42. Additionally, the shoulder rest 18 is pivotally connected to the top of the backrest by hinge structure 44 so that the arm rests 14 serve as linkage tilting the shoulder rest forwardly when the seat portion 11 is reclined, as illustrated diagrammatically in FIGS. 2 and 3.

When the user sits in the chair in its upright position, the moment force acting at the pivot A created by the user's weight is balanced effectively by the resultant spring force acting through the axis B, and the chair is in equilibrium. This equilibrium, however, may be upset by the user leaning back to shift his weight rearwardly. This increases the moment arm his weight causes with the axis A, and the chair begins to tilt backwards. The compressible arm 30 is thus compacted against the increasing resilience of the spring 36. As the user continues to lean further back, his center of gravity moves rearwardly to increase the moment arm to the axis A, and thus the moment force acting on the axis A is continually increasing. Consequently, the chair tends to accelerate as it is tilted and thus would uncomfortably come to an abrupt stop when it reached the limit of its travel. Further, it would be difficult for the user to stop and hold the tilting of the chair at any desired point before its limit of travel is reached. Additionally, the return of the chair to its initial upright position would similarily be difficult and it would often require extra effort to start the chair in motion towards its initial upright position.

These adverse effects can be reduced by assuring that the resultant force of the spring acting on the rear of the seat portion 11 continually increases at the same rate as the increasing moment force when the chair is tilting backwards and, likewise, continually decreases as the chair returns to its upright position.

This relationship can be approached by orientating the compressible arm 30 so that it forms with the seat portion 11 an angle continually decreasing during reclining of the seat portion and, similarily, continually increasing during return of the chair to its initial upright position. Such angle should also be acute at its maximum and, preferably, never exceed 45°.

FIG. 4 illustrates just such a relationship as it is carried out by the embodiment illustrated in FIG. 1. In FIG. 4, the axes A, B and C are suitably labeled as apices of a triangle, and side c of the triangle represents the seat portion 11, side a the compressible arm 30 and side b the support arm 24. The weight of the user is represented by W and the force of this weight passes, of course, through the user's center of gravity. The distance of the force W from the axis A is represented by d and the interior angle the force W makes with the seat portion 11 is indicated by $\theta$. $F_R$ represents the resultant force of the arm 30 acting on the rear of the seat portion 11, and this force acts along the axis of the arm 30 to form the angle $\gamma$ with the seat portion 11.

When the chair is in equilibrium, the moment force about the axis A caused by the reaction force $F_R$ of the spring must equal the moment force caused by the user's weight about axis A, i.e., $$dW\sin\theta = cF_R\sin\gamma \quad (1)$$

In order to maintain the desired smooth motion of the chair, both sides of the above equation must be changed proportionately during movement of the chair. Since the length of the seat portion c and the user's weight W may be considered constants, equation (1) can be simplified as $$d\sin\theta = F_R\sin\gamma. \quad (2)$$

As the user leans back in the chair to recline it, the length d increases and the angle $\theta$ decreases. Additionally, the reaction force $F_R$ increases as the spring is compressed. Consequently, the angle $\gamma$ should continually decrease to maintain the proper porportion for both sides of equation (2).

Consequently, by arranging the compressible arm 30 at an angle continually decreasing as the chair is reclined, or continually increasing as the chair is returned to its upright position, a spring force porportional for a particular individual's weight can be selected to maintain the chair in a nearly balanced condition throughout its entire range of motion. In this way, the chair can be reclined with a relatively constant velocity to prevent abrupt stops, and movement of the chair in either direction can be stopped at any time and the chair held in that position quite easily. Further, movement to return the chair from its fully reclined position can be started quite easily.

As noted above, the arm 30 is connected to the support arm 24 at a central location generally below the center of gravity of the user. The reaction forces of the compressible arm 30 are thus directed through this central location and the chair is thus highly stable.

A second embodiment of the present invention is illustrated in FIG. 5 where reference numerals similar to those of FIG. 1 are used to identify similar elements. In the second embodiment, a compressible arm 30' is connected pivotally to the base portion of the chair at a location generally below the forward portion of the seat portion 11 and, preferably, right below the pivotal connection of the seat portion 11 to the support arm 24. The axes A and C are thus aligned substantially vertically and the angle the arm 30' forms with the seat portion 11 is even more acute than that formed in the embodiment of FIG. 1. The same relationships illustrated in FIG. 4 for the embodiment of FIG. 1, however, apply generally to the embodiment of FIG. 5.

As can be well appreciated from the analysis of the embodiment of FIG. 1, the spring force should preferably change at a rate corresponding to the change in moment force about the axis and it is thus desirable that a particular change in the tilt of the chair always change the spring length the same distance, e.g., for every 5° of motion of the seat portion 11 anywhere within its path of motion, the spring should change its length by a fixed amount, such as $\frac{1}{4}$ in.

The length of the compressible arm of each embodiment is determined by the locus of the axis B which is, of course, a circular arc having its center on axis A and radius the length of the seat portion 11. This locus is essentially vertical and thus the more vertical the compressible arm is at any point along the path of movement of the chair, the more it must contract during downward movement of the seat portion 11, or the more it must expand during upward movement. As illustrated in FIGS. 2 and 3, the arm 30 of the first embodiment is initially at an angle of approximiately 45° with the horizontal and eventually pivots to a generally horizontal position and thus the arm 30 has a slightly faster rate of contraction when the chair begins to recline.

In the embodiment of FIG. 5, the arm 30' is arranged to pass through the horizontal during movement of the chair between its full upright and reclining positions. The horizontal position of the arm 30' may occur when the chair is midway between its full upright and full reclining positions. The deviation of the arm from its horizontal position is thus kept to a minimum and the contraction rate of the arm is thus more uniform than in the embodiment of FIG. 1.

The arrangement of the arm 30' with the seat portion 11 is shown in the diagram of FIG. 8 where the solid line represents their arrangement when the chair is fully upright and the broken line represents the fully reclining position. The horizontal of the arm is indicated by line H.

The arm 30' of the embodiment of FIG. 5 may be of any type compressible with progressive resistance, and preferably includes a rod 50 connected pivotally at one end to the rear of seat portion 11 by hinge structure 52 extending along axis B and having its other end extending slidable through block 54 mounted pivotally to the base portion by hinge structure 56 extending along axis C. A compression spring 60 extends over the rod 50 and is held between the block 54 and an enlarged knob 62 threadedly engaged with the rod. In this way, the force of the spring can be adjusted by turning knob 62. The resultant force of the spring 60 acts generally horizontally and thus must be stronger than the spring of the arm of the first embodiment in order to effectively counteract the moment forces created by the user's weight. Preferably, the spring can generate a force of 215 lbs./in. when initially compressed.

The present invention has been described with reference to two embodiments thereof. The present invention is not, however, limited by the details of these embodiments but may be carried out in other forms fitting within the general scope of the following claims.

What is claimed is:

1. A chair including a base portion, a seat portion connected pivotally at its forward end to said base portion and adapted to be reclined, and means including an arm compressible with progressive resistance for supporting a rear portion of said seat portion, said arm having spaced-apart portions respectively connected pivotally to said rear portion and pivotally to said base portion to form with said seat portion an angle continually decreasing during reclining of said seat portion.

2. A chair according to claim 1, said angle being a maximum of approximately 45°.

3. A chair according to claim 1 or 2, said arm being connected to that portion of said base portion located generally below the center of gravity of any person sitting upon said seat portion.

4. A chair according to claim 3, said arm comprising an outer tubular member, an inner tubular member slidable telescopingly within said outer tubular member, a spring held under compression between opposed ends of said members, and means for adjusting the distance between said opposed ends.

5. A chair according to claim 1 or 2, said arm being adapted to pivot through the horizontal as said seat portion is pivoted between its two extreme positions.

6. A chair according to claim 5, said arm being horizontal when said chair is approximately at the mid point between its extreme positions.

7. A chair according to claim 5, said arm comprising a rod connected pivotally at one end to the rear portion of said seat portion and its other end extending slidably through a block mounted pivotally to said base portion, a compression spring held between said block and a knob threadedly engaged with said rod whereby the compression of said spring may be adjusted by turning said knob.

8. A chair according to claim 1, in which said pivotal attachment of said seat portion to said base portion is located generally vertically above said pivotal attachment of said arm to said base portion.

* * * * *